US010577839B2

(12) United States Patent
Perkins

(10) Patent No.: US 10,577,839 B2
(45) Date of Patent: Mar. 3, 2020

(54) OVER CENTER MECHANISM AND METHOD OF USE

(71) Applicant: Inteva Products, LLC, Troy, MI (US)

(72) Inventor: Donald M. Perkins, Sterling Heights, MI (US)

(73) Assignee: INTEVA PRODUCTS, LLC, Troy, MI (US)

( * ) Notice: Subject to any disclaimer, the term of this patent is extended or adjusted under 35 U.S.C. 154(b) by 931 days.

(21) Appl. No.: 15/180,891

(22) Filed: Jun. 13, 2016

(65) Prior Publication Data

US 2016/0362915 A1 Dec. 15, 2016

Related U.S. Application Data

(60) Provisional application No. 62/174,516, filed on Jun. 11, 2015.

(51) Int. Cl.

| | |
|---|---|
| ***E05B 81/16*** | (2014.01) |
| ***E05B 79/08*** | (2014.01) |
| *E05B 15/04* | (2006.01) |

(52) U.S. Cl.

CPC ..... *E05B 79/08* (2013.01); *E05B 81/16* (2013.01); *E05B 2015/0493* (2013.01); *Y10T 292/1082* (2015.04); *Y10T 292/307* (2015.04)

(58) Field of Classification Search

CPC ..... Y10T 292/307; Y10T 292/308; Y10T 292/1082; E05B 2015/0493

See application file for complete search history.

(56) References Cited

U.S. PATENT DOCUMENTS

| | | | | | |
|---|---|---|---|---|---|
| 1,923,679 | A * | 8/1933 | Marple | E05B 85/22 | 292/145 |
| 3,236,551 | A * | 2/1966 | Nash | E05B 83/16 | 292/11 |
| 3,905,624 | A * | 9/1975 | Fujita | E05B 83/16 | 292/11 |
| 3,917,330 | A * | 11/1975 | Quantz | E05B 81/14 | 292/201 |
| 3,969,789 | A | 7/1976 | Wize | | |
| 4,226,001 | A * | 10/1980 | Salice | E05D 11/1021 | 16/294 |
| 4,329,759 | A * | 5/1982 | Lautenschlager | E05D 5/0246 | 16/335 |

(Continued)

FOREIGN PATENT DOCUMENTS

DE 102007055413 A1 * 5/2009 ..... E05B 77/24

*Primary Examiner* — Carlos Lugo

(74) *Attorney, Agent, or Firm* — Cantor Colburn LLP

(57) ABSTRACT

A system, the system having: a pair of levers; and an over center spring secured to each of the pair of levers such that each leg of the over center spring is received by features on each respective lever, wherein opposing forces on each leg of the over center spring creates a negative torque on a first one of the pair of levers and a positive torque on a second one of the pair of levers when the system is in a first position and wherein the system when in a second position approximately half way to a final position from the first position provides zero torque to the pair of levers and wherein the system when in the final position creates a positive torque on the first one of the pair of levers and a negative torque on the second one of the pair of levers when the system is in the final position.

20 Claims, 5 Drawing Sheets

(56) References Cited

U.S. PATENT DOCUMENTS 4,906,035 A * 3/1990 Nagai ..... E05B 81/20 292/201
4,979,384 A * 12/1990 Malesko ..... E05B 81/14 292/201
5,020,838 A * 6/1991 Fukumoto ..... E05B 81/14 292/201
5,090,754 A * 2/1992 Thompson ..... E05C 17/32 292/262
5,632,515 A * 5/1997 Dowling ..... E05B 81/14 292/216
6,059,327 A * 5/2000 Yoshikuwa ..... E05B 83/16 292/216
6,131,967 A * 10/2000 Kondo ..... E05B 81/20 292/201
6,267,420 B1 * 7/2001 Miyagawa ..... E05B 83/16 292/216
6,406,073 B1 * 6/2002 Watanabe ..... E05B 77/265 292/216
6,568,741 B1 5/2003 Leung et al.
6,679,531 B2 1/2004 Rogers, Jr. et al.
6,695,360 B1 * 2/2004 Forsell ..... E05B 83/16 292/201
6,773,042 B2 * 8/2004 Spurr ..... E05B 77/02 292/201
6,945,585 B1 * 9/2005 Liu ..... B60N 2/01583 292/216
7,416,229 B2 * 8/2008 Stefanic ..... E05B 81/14 292/201
7,559,586 B2 * 7/2009 Fukunaga ..... E05B 81/06 292/201
7,905,524 B2 * 3/2011 Migli ..... E05C 19/022 16/235
8,328,249 B2 12/2012 Corrales et al.
8,348,310 B2 1/2013 Vazquez et al.
8,894,106 B2 11/2014 Vazquez et al.
8,967,679 B2 3/2015 Estrada et al.
9,057,211 B2 * 6/2015 Scholz ..... E05B 85/26
2010/0127512 A1 5/2010 Vazquez et al.
2014/0292000 A1 10/2014 Vazquez et al.
2015/0240536 A1 * 8/2015 Cumbo ..... E05B 85/20 292/200

* cited by examiner

OVER CENTER MECHANISM AND METHOD OF USE

CROSS REFERENCE TO RELATED APPLICATIONS

This application claims the benefit of U.S. Provisional Patent Application Ser. No. 62/174,516, filed on Jun. 11, 2015, the entire contents of which are incorporated herein by reference thereto.

BACKGROUND

Various embodiments of the present invention relate to an over centering device and in one embodiment, an over centering device for use in a vehicle latch. Still further, various embodiments of the present invention relate to an over centering device that is configured to not interfere with operable components the over centering device is secured to.

A common mechanism often used in door latch design, and many other common mechanisms, is an over centering device. It can be found on rotating or translating members of the mechanism assembly. The purpose of this type of mechanism is to maintain the position of the associated component in one determined position or in an alternative position. In the application of a latch assembly, the over-centering device might hold a lock lever, in the locked, or unlocked position thus maintaining the predetermined position.

An over centering device can come in many forms, but they are most commonly found in the form of spring devices that can come in many forms. Torsion springs are a very common form of over-centering device due to their relatively low cost and ease of assembly. One issue with using a torsional spring is packaging, since the rotation of the spring body can cause issues with the surrounding components of the mechanism.

Accordingly, it is desirable to provide an over centering device the does not adversely affect surrounding components of the device the spring is secured to.

SUMMARY OF THE INVENTION

In one embodiment, a system is provided. The system having: a pair of levers; and an over center spring secured to each of the pair of levers such that each leg of the over center spring is received by features on each respective lever, wherein opposing forces on each leg of the over center spring creates a negative torque on a first one of the pair of levers and a positive torque on a second one of the pair of levers when the system is in a first position and wherein the system when in a second position approximately half way to a final position from the first position provides zero torque to the pair of levers and wherein the system when in the final position creates a positive torque on the first one of the pair of levers and a negative torque on the second one of the pair of levers when the system is in the final position.

In another embodiment, a vehicle latch is provided. The vehicle latch, having: a pair of levers configured for movement between a locked position and an unlocked position in order to place the latch in a locked state and an unlocked state; an over center spring secured to each of the pair of levers such that each leg of the over center spring is received by features on each respective lever, wherein opposing forces on each leg of the over center spring creates a negative torque on a first one of the pair of levers and a positive torque on a second one of the pair of levers when the system is in a first position corresponding to the locked position and wherein the system when in a second position approximately half way to a final position from the first position provides zero torque to the pair of levers and wherein the system when in the final position creates a positive torque on the first one of the pair of levers and a negative torque on the second one of the pair of levers when the system is in the final position, the final position corresponding to the locked position.

In yet another embodiment, a method for providing varying torques to a pair of levers of a system via an over center spring is provided. The method including the steps of pivotally mounting a first one of the pair of levers to a portion of a vehicle latch; pivotally mounting a second one of the pair of levers to another portion of the vehicle latch; securing a first leg of the over center spring to a feature of the first one of the pair of levers; securing a second leg of the over center spring to a feature of the second one of the pair of levers; and wherein opposing forces on first leg and the second leg of the over center spring creates a negative torque on the first one of the pair of levers and a positive torque on the second one of the pair of levers when the pair of levers are in a first position corresponding to a locked position of the latch and when the pair of levers are in a second position approximately half way to a final position from the first position provides zero torque to the pair of levers and wherein the pair of levers when in the final position corresponding to an unlocked position of the latch creates a positive torque on the first one of the pair of levers and a negative torque on the second one of the pair of levers when the system is in the final position.

BRIEF DESCRIPTION OF THE DRAWINGS

These and/or other features, aspects, and advantages of the present invention will become better understood when the following detailed description is read with reference to the accompanying drawings in which like characters represent like parts throughout the drawings, wherein:

FIG. 2 illustrates the two lock levers and the over center spring in a position that is approximately 50% of a full travel from the first position of the system the two lock levers are associated with;

Although the drawings represent varied embodiments and features of the present invention, the drawings are not necessarily to scale and certain features may be exaggerated in order to illustrate and explain exemplary embodiments the present invention. The exemplification set forth herein illustrates several aspects of the invention, in one form, and such exemplification is not to be construed as limiting the scope of the invention in any manner.

DETAILED DESCRIPTION

As will be described herein, a unique application of a torsion spring over-centering feature is provided. The torsion spring over-centering feature is optimally packaged without creating issues with performance or assembly the spring is associated with. In one non-limiting illustrated application, a solution is provided to hold two counter rotating levers into a locked or unlocked position effectively and efficiently.

Figure 1:
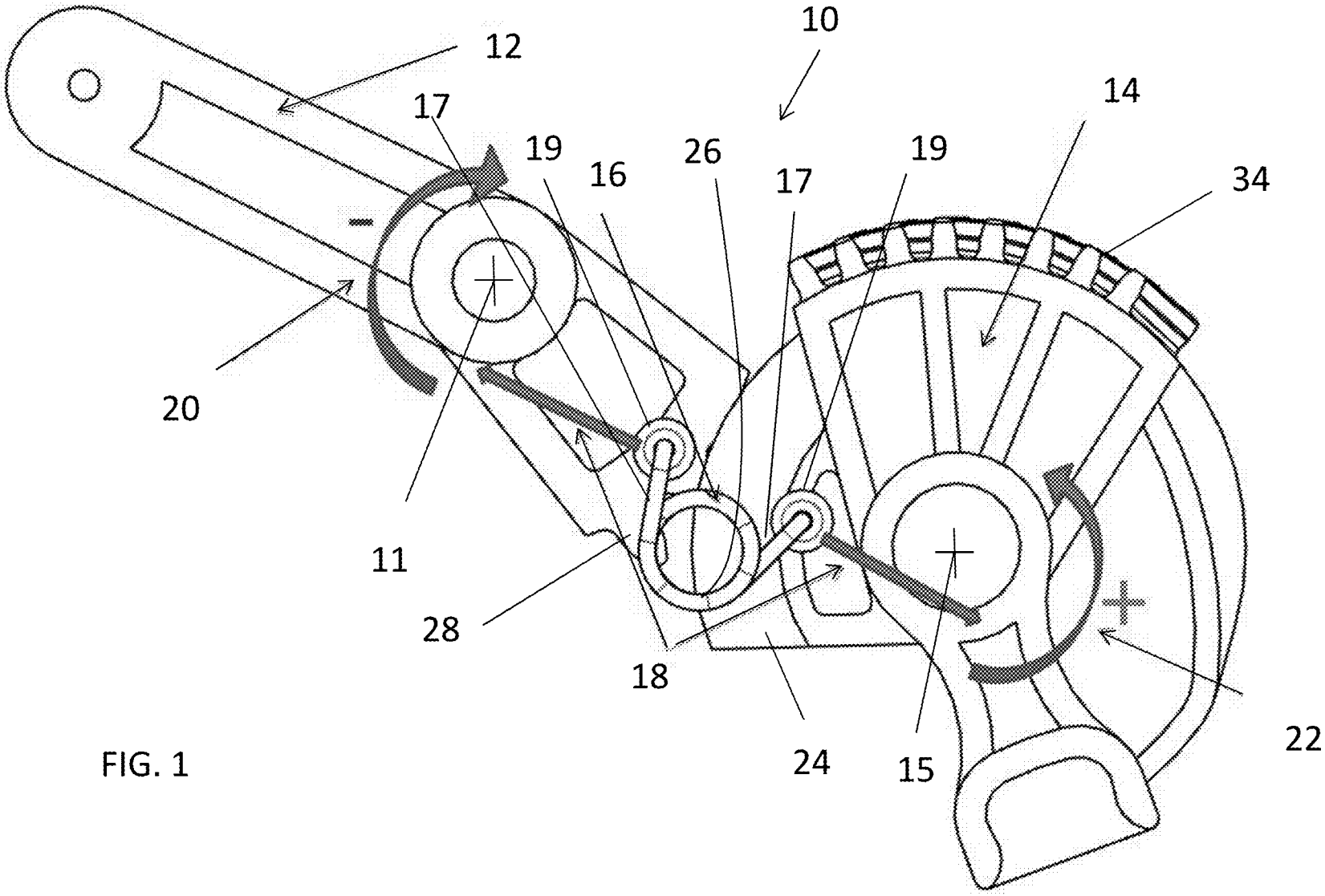
FIG. 1 illustrates two lock levers and an over center spring of a system in a first position of travel in accordance with one non-limiting embodiment of the present invention.

FIG. 1 shows a system 10 comprising two levers, a lock lever 12 pivotally mounted to a component, which in one embodiment may be a vehicle latch or an actuator of a vehicle latch for pivotal or rotational movement about an axis 11 and a lock sector 14 pivotally mounted to the component for pivotal or rotational movement about an axis 15. The lock lever 12 and the lock sector 14 are operatively coupled to each other. The system includes an over center spring 16 installed in a manner such that each leg 17 of the spring is received by features 19 on each respective lever. This geometry creates opposing forces 18 on each of the spring legs 17 that creates a negative torque 20 on the lock lever 12 with respect to axis 11 and a positive torque 22 on lock sector 14 with respect to axis 15 when they are in the position illustrated in FIG. 1. FIG. 1 illustrates the system 10 in a first position of travel in accordance with one non-limiting embodiment of the present invention.

Figure 2:
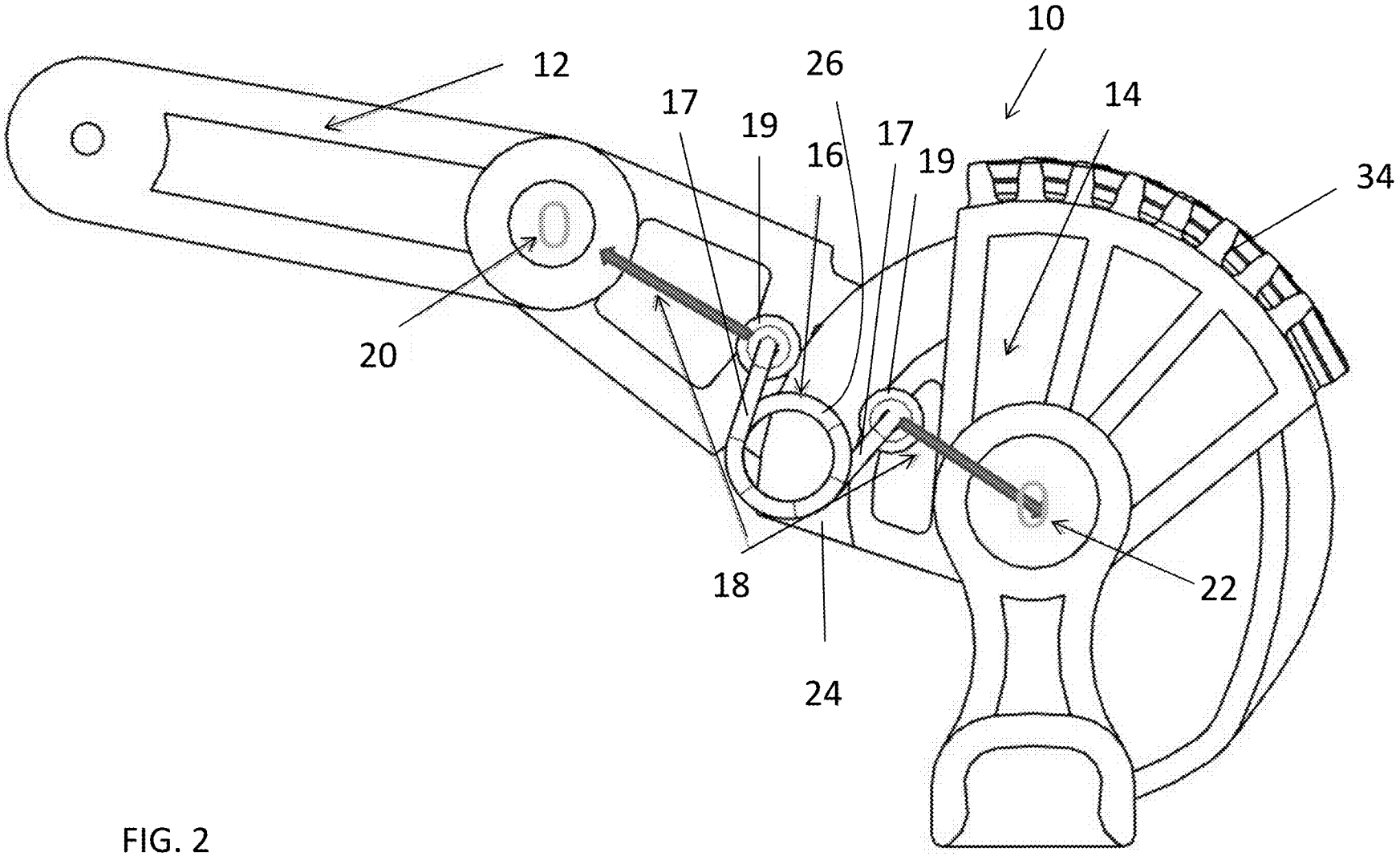

FIG. 2 depicts the levers in a position that is 50% of full travel of the system. When the system is in this position, the opposing forces 18 created from the spring 16 translate through the center of the levers thus zero torque is provided to the levers. As the system continues to rotate the torque of the levers reverse as the spring passes this point of zero torque, thus going over center. Of course, other positions of travel of the system greater or less than 50% of the full travel of the system may be configured as the point of zero torque being applied to each of the levers.

Figure 3:
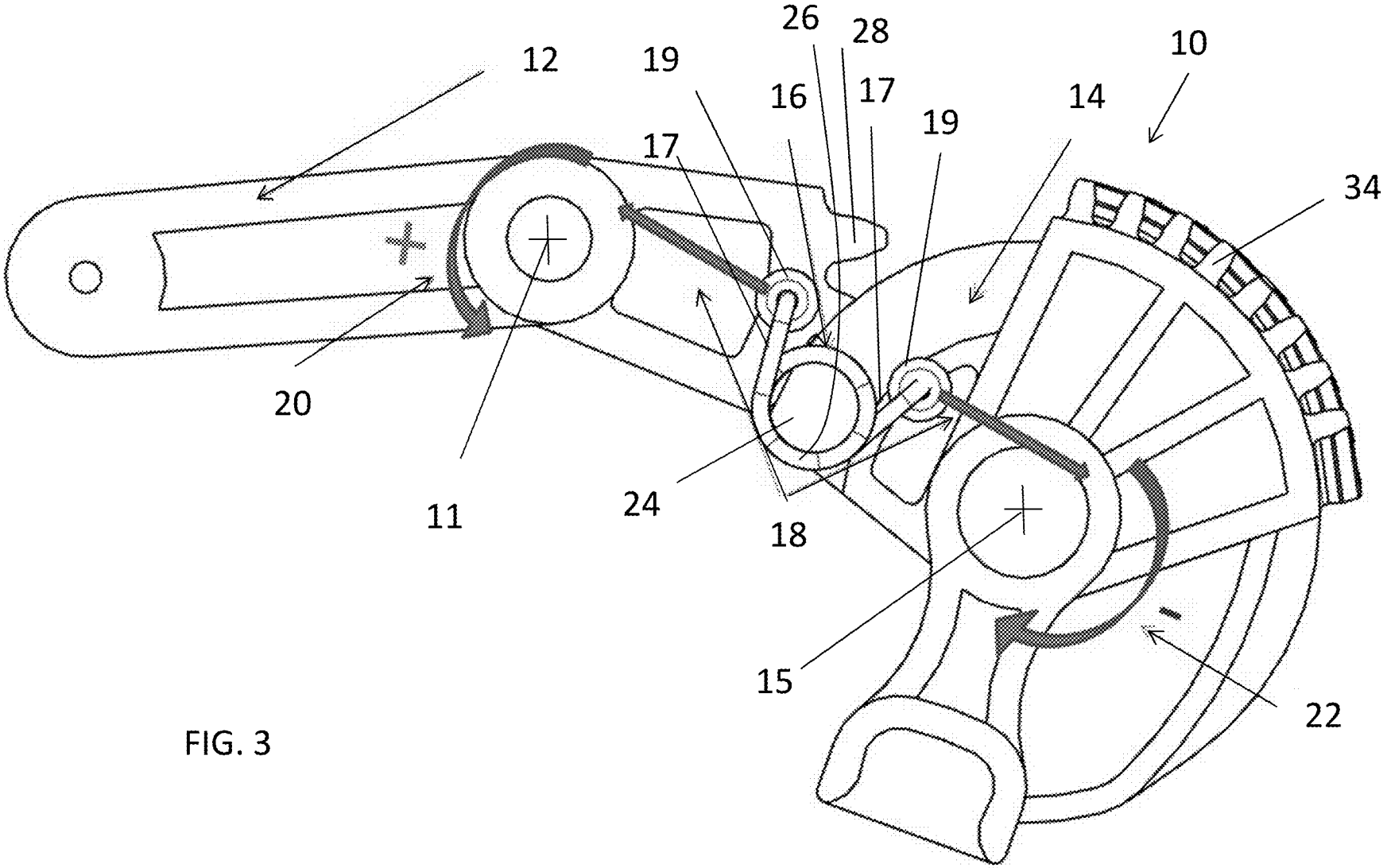
FIG. 3 illustrates a final or full travel position of the system having the two lock levers and the over center spring from the first position.

FIG. 3 illustrates the final travel position of the system with the spring forces 18 creating opposite torques 20, 22 to their respective levers. In one embodiment, the first position of the system 10 may refer to the locked position of the lock lever 12 and the lock sector 14 and the final position of the system 10 may refer to the unlocked position of the lock lever 12 and the lock sector 14. Alternatively, the first position of the system 10 may refer to the unlocked position of the lock lever 12 and the lock sector 14 and the final position of the system 10 may refer to the locked position of the lock lever 12 and the lock sector 14. In one non-limiting embodiment and as used herein locked position may refer to a latch or vehicle latch that is in a locked state and unlocked position may refer to a latch or vehicle latch that is in an unlocked position. In one non-limiting embodiment, the transition of the latch or vehicle latch between the unlocked position and the locked position may be achieved by an actuator of the latch or vehicle latch.

Additional benefits may be realized by a supporting feature 24 (designed into the lock sector in this case) that will not allow interrelation between a body or spring body 26 of the spring 16 and other sensitive features, in this case the gear teeth 28 between the lock lever 12 and the lock sector 14.

This unique geometry illustrates a minimal packaging space required for this design of an over centering device or spring 16 as compared to other over center mechanisms.

As mentioned above, the over centering device may be used in a vehicle latch, non-limiting configurations of which are found in the following U.S. Pat. Nos. 3,969,789; 6,568,741; 6,679,531; 8,328,249; 8,348,310; 8,894,106; and 8,967,679 and U.S. Patent Publication Nos. US 2010/0127512; and US 2014/0292000, the entire contents each of which are incorporated herein by reference thereto. Still further, various embodiments of the present invention relate to an over centering device that is configured to not interfere with operable components the over centering device is secured to.

Figure 4:
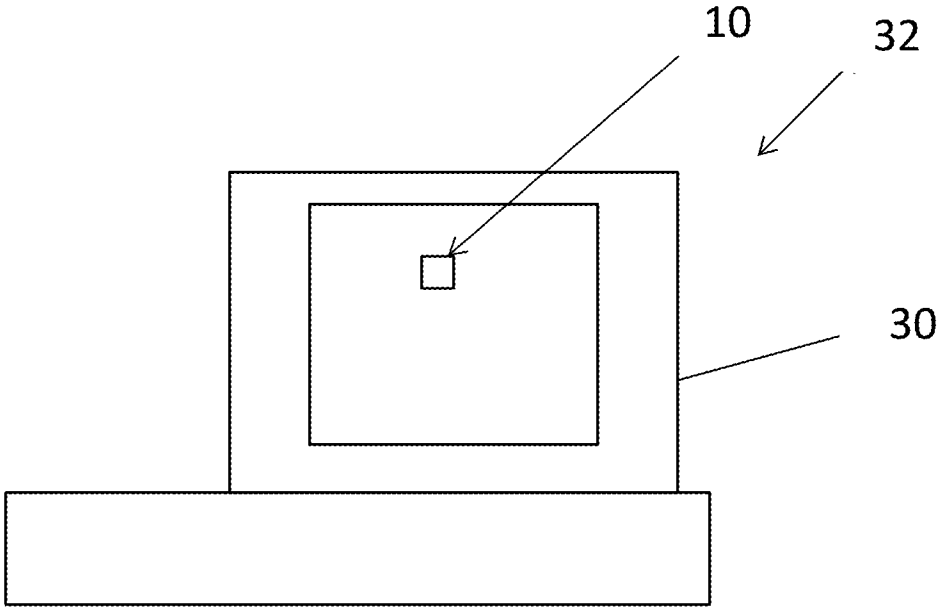
FIG. 4 is a non-limiting schematic illustration of a vehicle latch.

In one embodiment, the lock lever 12, the lock sector 14 and the over center spring 16 may be components of an actuator 30 of a vehicle latch 32 illustrated schematically in FIG. 4. Non-limiting examples of an actuator 30 and/or vehicle latch 32 can be found in U.S. Pat. Nos. 3,969,789; 6,568,741; 6,679,531; 8,328,249; 8,348,310; 8,894,106; and 8,967,679 and U.S. Patent Publication Nos. US 2010/0127512; and US 2014/0292000, the entire contents each of which are incorporated herein by reference thereto.

Figure 5:
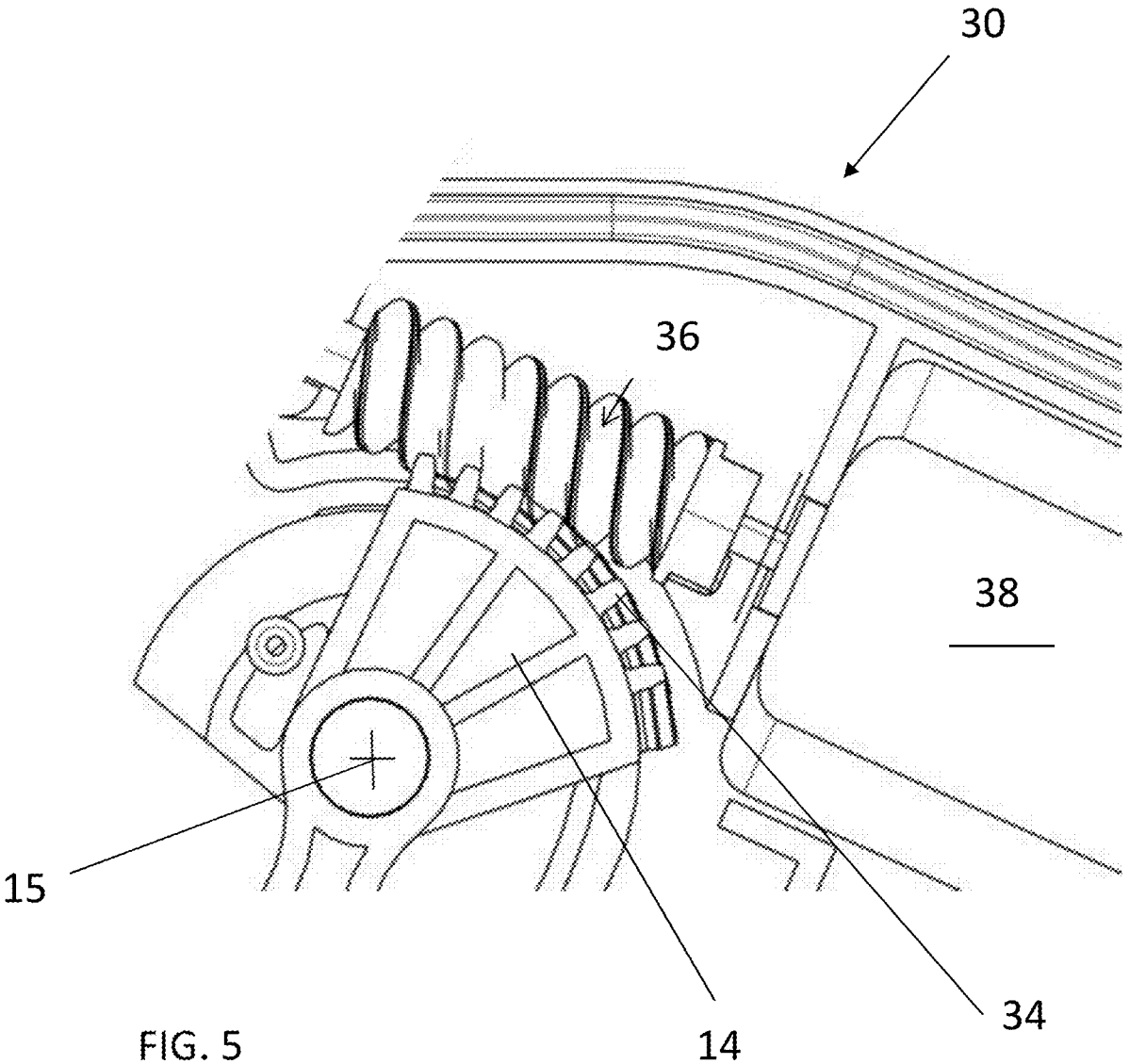
FIG. 5 is a schematic illustration of a portion of an actuator of a vehicle latch.

In one embodiment and as illustrated in at least FIG. 5, the gear teeth 34 of the lock sector may be driven by a worm 36 operatively coupled to a motor 38 of the actuator 30 of the latch 32.

As illustrated in the attached FIGS. the over centering device or spring 16 applies the reversing torques to the lock lever 12 and the lock sector 14 without interfering with the aforementioned sensitive features such as gear teeth 28 while also requiring a minimal amount of required real estate or space for the over centering device or spring 16 and its required movement within the actuator 30 or latch or vehicle latch 32.

As used herein, the terms "first," "second," and the like, herein do not denote any order, quantity, or importance, but rather are used to distinguish one element from another, and the terms "a" and "an" herein do not denote a limitation of quantity, but rather denote the presence of at least one of the referenced item. In addition, it is noted that the terms "bottom" and "top" are used herein, unless otherwise noted, merely for convenience of description, and are not limited to any one position or spatial orientation.

The modifier "about" used in connection with a quantity is inclusive of the stated value and has the meaning dictated by the context (e.g., includes the degree of error associated with measurement of the particular quantity).

While the invention has been described with reference to an exemplary embodiment, it will be understood by those skilled in the art that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims.

What is claimed is:

1. A system, comprising:

a pair of levers operatively coupled to each other, each one of the pair of levers defining a pivotal axis; and an over center spring secured to each of the pair of levers, and defining a pair of legs such that each leg of the over center spring is received at a point of contact between features on each respective lever and the pair of legs, wherein, when the pair of levers are operatively coupled at a first position and the point of contact between features on each respective lever and the pair of legs are positioned below an intersection line intersecting the pivotal axis of each of the pair of levers, opposing forces on each leg of the over center spring creates a negative torque on a first one of the pair of levers and a positive torque on a second one of the pair of levers and wherein, when the pair of levers are operatively coupled at a second position half way to a final position from the first position and the point of contact between features on each respective lever and the pair of legs are positioned along the intersection line, opposing forces on each leg of the over center spring provides zero torque to the pair of levers; and wherein, when the pair of levers are operatively coupled at a final position and the point of contact between features on each respective lever and the pair of legs are positioned above the intersection line, opposing forces on each leg of the over center spring creates a positive torque on the first one of the pair of levers and a negative torque on the second one of the pair of levers when the system is in the final position.

2. The system as in claim 1, wherein one of the pair of levers is a lock lever and the other one of the pair of levers is a lock sector configured for use in a vehicle latch.

3. The system as in claim 1, wherein the over center spring is a torsion spring.

4. The system as in claim 1, wherein one of the pair of levers is a lock lever and the other one of the pair of levers is a lock sector and wherein the lock lever is operatively coupled to the lock sector via a plurality of gear teeth located on the lock lever.

5. The system as in claim 4, wherein the over center spring is a torsion spring.

6. The system as in claim 5, wherein the lock sector has a supporting feature configured to prevent interrelation between a body of the spring body with the gear teeth of the lock lever.

7. The system as in claim 6, wherein the lock sector has a plurality of gear teeth.

8. A vehicle latch, comprising:

a pair of levers configured for movement between a locked position and an unlocked position in order to place the latch in a locked state and an unlocked state, the pair of levers being operatively coupled to each other and each one of the pair of levers defining a pivotal axis;

an over center spring secured to each of the pair of levers, and defining a pair of legs such that each leg of the over center spring is received at a point of contact between by features on each respective lever and the pair of legs, wherein, when the pair of levers are operatively coupled at a first position corresponding to the locked position and the point of contact between features on each respective lever and the pair of legs are positioned below an intersection line intersecting the pivotal axis of each of the pair of levers, opposing forces on each leg of the over center spring creates a negative torque on a first one of the pair of levers and a positive torque on a second one of the pair of levers and wherein, when the pair of levers are operatively coupled at a second position half way to a final position from the first position and the point of contact between features on each respective lever and the pair of legs are positioned along the intersection line, opposing forces on each leg of the over center spring provides zero torque to the pair of levers; and wherein, when the pair of levers are operatively coupled at a final position and the point of contact between features on each respective lever and the pair of legs are positioned above the intersection line, opposing forces on each leg of the over center spring creates a positive torque on the first one of the pair of levers and a negative torque on the second one of the pair of levers when the system is in the final position, the final position corresponding to the locked position.

9. The latch as in claim 8, wherein one of the pair of levers is a lock lever and the other one of the pair of levers is a lock sector.

10. The latch as in claim 9, wherein the over center spring is a torsion spring.

11. The latch as in claim 8, wherein one of the pair of levers is a lock lever and the other one of the pair of levers is a lock sector and wherein the lock lever is operatively coupled to the lock sector via a plurality of gear teeth located on the lock lever.

12. The latch as in claim 11, wherein the over center spring is a torsion spring.

13. The latch as in claim 12, wherein the lock sector has a supporting feature configured to prevent interrelation between a body of the spring body with the gear teeth of the lock lever.

14. The latch as in claim 13, wherein the lock sector has a plurality of gear teeth.

15. The latch as in claim 14, further comprising a motor operatively coupled to the plurality of gear teeth of the lock sector.

16. The latch as in claim 15, wherein the motor is located in an actuator of the latch.

17. A method for providing varying torques to a pair of levers of a system via an over center spring, comprising:

pivotally mounting a first one of the pair of levers to a portion of a vehicle latch;

pivotally mounting a second one of the pair of levers to another portion of the vehicle latch, the pair of levers being operatively coupled to each other and each one of the pair of levers defining a pivotal axis;

securing a first leg of the over center spring to a feature of the first one of the pair of levers at a first point of contact;

securing a second leg of the over center spring to a feature of the second one of the pair of levers at a second point of contact; and wherein, when the pair of levers are operatively coupled at a first position corresponding to a locked position of the latch and the first point of contact and the second point of contact are positioned below an intersection line intersecting the pivotal axis of each of the pair of levers, opposing forces on first leg and the second leg of the over center spring creates a negative torque on the first one of the pair of levers and a positive torque on the second one of the pair of levers and when the pair of levers are operatively coupled at a second position half way to a final position from the first position and the first point of contact and the second point of contact are positioned along the intersection line, opposing forces on each leg of the over center spring provides zero torque to the pair of levers; and wherein, when the pair of levers are operatively coupled at a final position corresponding to an unlocked position of the latch and the first point of contact and the second point of contact are positioned above the intersection line, opposing forces on each leg of the over center spring creates a positive torque on the first one of the pair of levers and a negative torque on the second one of the pair of levers when the system is in the final position.

18. The method as in claim 17, wherein one of the pair of levers is a lock lever and the other one of the pair of levers is a lock sector and wherein the over center spring is a torsion spring.

19. The method as in claim 17, wherein one of the pair of levers is a lock lever and the other one of the pair of levers is a lock sector and wherein the lock lever is operatively coupled to the lock sector via a plurality of gear teeth located on the lock lever and wherein the over center spring is a torsion spring.

20. The method as in claim 19, wherein the lock sector has a supporting feature configured to prevent interrelation between a body of the spring body with the gear teeth of the lock lever.

* * * * *